US007816867B2

(12) United States Patent
Yoshinari et al.

(10) Patent No.: US 7,816,867 B2
(45) Date of Patent: Oct. 19, 2010

(54) PLASMA DISPLAY PANEL

(75) Inventors: Masaki Yoshinari, Yamanashi (JP); Yoichi Okumura, Yamanashi (JP); Tasuku Ishibashi, Yamanashi (JP); Yoichi Shintani, Yamanashi (JP)

(73) Assignee: Panasonic Corporation, Kadoma-shi, Osaka (JP)

( * ) Notice: Subject to any disclaimer, the term of this patent is extended or adjusted under 35 U.S.C. 154(b) by 1246 days.

(21) Appl. No.: 11/386,084

(22) Filed: Mar. 22, 2006

(65) Prior Publication Data

US 2006/0244380 A1 Nov. 2, 2006

(30) Foreign Application Priority Data

Mar. 23, 2005 (JP) ..... 2005-084297
Jan. 26, 2006 (JP) ..... 2006-017643

(51) Int. Cl.
*H01J 17/49* (2006.01)

(52) U.S. Cl. ..... 313/582

(58) Field of Classification Search ..... 313/582–587
See application file for complete search history.

(56) References Cited

FOREIGN PATENT DOCUMENTS

JP 2004-39578 2/2004

*Primary Examiner*—Joseph L Williams
(74) *Attorney, Agent, or Firm*—McGinn IP Law Group, PLLC

(57) ABSTRACT

In a PDP having row electrode pairs and column electrodes formed on the front glass substrate placed parallel to the back glass substrate with a discharge in between, each of the column electrodes faces a central area between adjacent transparent electrodes of the row electrode in the row direction, and is placed in a position closer to the transparent electrode serving as its partner for initiating an address discharge than to the unrelated transparent electrode located on the opposite side of the column electrode.

5 Claims, 12 Drawing Sheets

*FIRST EMBODIMENT*

SECTION V1-V1

SECTION V2-V2

SECTION W-W

FIRST EMBODIMENT

SECTION W1-W1

SECOND EMBODIMENT

SECTION W2-W2

THIRD EMBODIMENT

SECTION W3-W3

FOURTH EMBODIMENT

SECTION W4-W4

FIFTH EMBODIMENT

SECTION W5-W5

SIXTH EMBODIMENT

SECTION W6-W6

SEVENTH EMBODIMENT

SECTION W7-W7

EIGHTH EMBODIMENT

SECTION W8-W8

NINTH EMBODIMENT

SECTION W9-W9

PLASMA DISPLAY PANEL

BACKGROUND OF THE INVENTION

1. Field of the Invention

This invention relates to a panel structure of plasma display panels.

The present application claims priority from Japanese Applications No. 2005-084297 and No. 2006-017643, the disclosure of which is incorporated herein by reference.

2. Description of the Related Art

FIG. 1. to FIG. 4 illustrate the structure of a conventional plasma display panel (hereinafter referred to as "PDP"). FIG. 1 is a front view of the conventional PDP. FIG. 2 is a sectional view taken along the V1-V1 line in FIG. 1. FIG. 3 is a sectional view taken along the V2-V2 line in FIG. 1. FIG. 4 is a sectional view taken along the W-W line in FIG. 1.

In FIGS. 1 to 4, the conventional PDP includes a plurality of row electrode pairs (X, Y) which are arranged in parallel on the rear-facing face of a front glass substrate 1 serving as the display surface and extend in the row direction of the front glass substrate 1 (the right-left direction in FIG. 1).

A row electrode X is composed of T-shaped transparent electrodes Xa formed of a transparent conductive film made of ITO or the like, and a bus electrode Xb which is formed of a black- or dark-colored metal film and which extends in the row direction of the front glass substrate 1 and is connected to the narrow proximal ends of the transparent electrodes Xa.

A row electrode Y, likewise, is composed of T-shaped transparent electrodes Ya formed of a transparent conductive film made of ITO or the like, and a black bus electrode Yb which is formed of a black- or dark-colored metal film and which extends in the row direction of the front glass substrate 1 and is connected to the narrow proximal ends of the transparent electrodes Ya.

The row electrodes X and Y are arranged in alternate positions in the column direction of the front glass substrate 1 (the vertical direction in FIG. 1). In the two face-to-face row electrodes X and Y, the transparent electrodes Xa and Ya, which are regularly spaced along the associated bus electrodes Xb and Yb, each extend out toward their counterparts in the row electrode pair, so that the wide distal ends of the transparent electrodes Xa and Ya face each other across a discharge gap g of a required width.

Each of the row electrode pairs (X, Y) forms each of the display lines L of the panel.

Black or dark-colored light absorption layers (light-shield layers) 2 are further formed on the rear-facing face of the front glass substrate 1. Each of the light absorption layers 2 extends in the row direction along and between the back-to-back bus electrodes Xb and Yb of the respective row electrodes (X, Y) adjacent to each other in the column direction.

In turn, a first dielectric layer 3 is formed on the rear-facing face of the front glass substrate 1 and covers the row electrode pairs (X, Y) and the light absorption layers 2.

On the rear-facing face of the first dielectric layer 3, belt-shaped column electrode bodies Da each forming part of a column electrode D are regularly arranged in parallel at predetermined intervals. Each of the belt-shaped column electrode bodies Da extends in a direction at right angles to the row electrode pairs (X, Y) (i.e. in the column direction) and parallel to the centerline between the adjacent transparent electrodes Xa and adjacent transparent electrodes Ya which are spaced in the row direction along the associated bus electrodes Xb, Yb of the row electrodes X, Y.

Belt-shaped column-electrode discharge portions Db forming part of each column electrode D are further formed on the first dielectric layer 3 and integrally with each column electrode body Da. Each of the column-electrode discharge portions Db extends out from one side of the column electrode body Da in the row direction in each display line L such that the leading end of the column-electrode discharge portion Db is positioned opposite to a middle position of each discharge gap g between the transparent electrodes Xa and Ya of each row electrode pair (X, Y).

A second dielectric layer 4 is formed on the rear-facing face of the first dielectric layer 3 so as to cover the column electrode bodies Da and the column-electrode discharge portions Db of the column electrodes D.

Additional dielectric layers 4A project from the rear-facing face of the second dielectric layer 4 toward the rear of the PDP. Each of the additional dielectric layers 4A is formed on a portion of the second dielectric layer 4 opposite to the back-to-back bus electrodes Xb and Yb of the respective and adjacent row electrode pairs (X, Y) and also to the light absorption layer 2 located between these bus electrodes Xb and Yb so as to extend along the bus electrodes Xb and Yb in the row direction.

An MgO protective layer (not shown) is formed on the rear-facing faces of the second dielectric layer 4 and the additional dielectric layer 4A.

The front glass substrate 1 is placed opposite the back glass substrate 5 with a discharge space in between. An approximate grid-shaped partition wall unit 6 composed of belt-shaped vertical walls 6A and belt-shaped lateral walls 6B is formed on the front-facing face (i.e. the face facing toward the display surface of the PDP) of the back glass substrate 5. Each of the vertical walls 6A extends in the column direction along the portion of the back glass substrate 5 opposite the column electrode body Da formed on the front glass substrate 1. Each of the lateral walls 6B extends in the row direction along the portion of the back glass substrate 5 opposite the back-to-back bus electrodes Xb and Yb of the respective and adjacent row electrode pairs (X, Y) and the light absorption layer 2 located between these bus electrodes Xb and Yb. The partition wall unit 6 partitions the discharge space defined between the front glass substrate 1 and the back glass substrate 5 into areas each corresponding to paired transparent electrodes Xa and Ya in each row electrode pair (X, Y) to form quadrangular discharge cells C.

In each discharge cell C, a phosphor layer 7 covers the five faces: the surface of the back glass substrate 5 and the side faces of the vertical walls 6A and the lateral walls 6B of the partition wall unit 6. The primary colors, red, green and blue are applied to the phosphor layers 7 and arranged in this order in the row direction for the respective discharge cells C.

The discharge space between the front glass substrate 1 and the back glass substrate 5 is filled with a discharge gas that includes xenon.

A conventional PDP having such a structure is disclosed in Japanese unexamined patent publication 2004-39578, for example.

In the conventional PDP of a structure as described above the manufacturing process is simplified and the manufacturing cost is significantly reduced by forming both the row electrode pairs (X, Y) and the address electrodes D on the front glass substrate 1, and by forming the column electrode body Da and the column-electrode discharge portion Db in the same plane on the rear-facing face of the first dielectric layer 3. However, the conventional PDP has problems as described below.

Specifically, when the PDP is driven, as illustrated in FIG. 1, an address discharge d for selecting the discharge cells C to allow it to emit light is initiated between the transparent electrode Ya of the row electrode Y and the column-electrode discharge portion Db of the address electrode D, and also between the transparent electrode Ya and the column electrode body Da adjacent to a side of the transparent electrode Ya.

However, in the conventional PDP, the column electrode body Da of the address electrode D is located adjacent to another transparent electrode Ya which faces toward an unrelated discharge cell C adjacent to the required discharge cell in the row direction. For this reason of positional relation, a false address discharge ed may also be initiated between the address electrode D and the adjacent unrelated transparent electrode Ya, resulting in selecting the discharge cell C which must not the one to be selected.

SUMMARY OF THE INVENTION

It is a technical object of the present invention to solve the problem arising in a conventional PDP having row electrode pairs and column electrodes both formed on one substrate as described above.

To attain this object, a plasma display panel according to an aspect of the present invention is provided with a pair of first and second substrates placed parallel to each other on either side of a discharge space, and further with on the first substrate a plurality of row electrode pairs extending in a row direction and regularly arranged in a column direction and a plurality of column electrodes extending in the column direction and regularly arranged in the row direction, with a plurality of unit light emission areas being formed in matrix form within the discharge space for initiating a discharge therein by use of the row electrode pairs and the column electrodes. The row electrodes paired to constitute each of the row electrode pairs have discharge portions placed in accordance with the unit light emission areas and opposite to each other with a discharge gap in between. Each of the column electrodes is placed parallel to a central area between the discharge portions of each row electrode which are adjacent to each other in the row direction, and in a position closer to the discharge portion serving as a partner of the column electrode for initiating a discharge than to another discharge portion which is located on the opposite side of the column electrode from the discharge portion serving as the partner for initiating the discharge.

To attain the above object, a PDP according to another aspect of the present invention is provided with a pair of opposing substrates placed on either side of a discharge space, and further with on one substrate of the pair of substrates a plurality of row electrode pairs extending in a row direction and regularly arranged in a column direction and a plurality of column electrodes extending in the column direction and regularly arranged in the row direction, with a plurality of unit light emission areas being formed in matrix form within the discharge space for initiating a discharge therein by use of the row electrode pairs and the column electrodes. The PDP is further provided with a partition wall unit provided between the pair of substrates and having at least vertical walls each extending in the column direction to provide a partition between the unit light emission areas adjacent to each other in the row direction in the discharge space. The row electrodes paired to constitute each of the row electrode pairs have discharge portions placed in accordance with the unit light emission areas and opposite to each other with discharge gap in between. Each of the column electrodes is placed parallel to a central area between the discharge portions of each row electrode which are adjacent to each other in the row direction. Each of the vertical walls of the partition wall unit is placed parallel to the column electrode and in a position farther away from the discharge portion which serves as a partner of the column electrode for initiating a discharge than from another discharge portion which is located on the opposite side from the discharge portion serving as the partner for initiating the discharge.

To attain the above object, a PDP according to still another aspect of the present invention is provided with a pair of first and second substrates placed parallel to each other on either side of a discharge space, and further with on the first substrate a plurality of row electrode pairs extending in a row direction and regularly arranged in a column direction and a plurality of column electrodes extending in the column direction and regularly arranged in the row direction, with a plurality of unit light emission areas being formed in matrix form within the discharge space for initiating a discharge therein by use of the row electrode pairs and the column electrodes. The row electrode pairs are overlain by a dielectric layer formed on a rear-facing face of the first substrate. The row electrodes paired to constitute each of the row electrode pairs have discharge portions placed in accordance with the unit light emission areas and opposite to each other with a discharge gap in between. Each of the column electrodes is provided on a rear-facing face of the dielectric layer overlying the row electrode pairs and placed parallel to a central area between the discharge portions of each row electrode which are adjacent to each other in the row direction. Dielectric additional portions projecting from the dielectric layer toward the second substrate, and each extending in the column direction and overlying the column electrode are formed on the rear-facing face of the dielectric layer overlying the row electrode pairs. Each of the dielectric additional portions is placed in a position farther away from the discharge portion which serves as a partner of the column electrode overlain by the dielectric additional portion for initiating a discharge than from another discharge portion which is located on the opposite side from the discharge portion serving as the partner for initiating the discharge.

To attain the above object, a PDP according to yet another aspect of the present invention is provided with a pair of first and second substrates placed parallel to each other on either side of a discharge space, and further with on the first substrate a plurality of row electrode pairs extending in a row direction and regularly arranged in a column direction, a plurality of column electrodes extending in the column direction and regularly arranged in the row direction and a dielectric layer for covering the row electrode pairs and also covering the column electrodes at a distance from the row electrode pairs, with a plurality of unit light emission areas being formed in matrix form within the discharge space for initiating a discharge therein by use of the row electrode pairs and the column electrodes. The row electrode pairs are covered by the dielectric layer formed on a rear-facing face of the first substrate, and row electrodes paired to constitute each of the row electrode pairs have discharge portions placed in accordance with the unit light emission areas and opposite to each other with discharge gap in between. Each of the column electrodes is placed on a rear-facing face of the dielectric layer covering the row electrode pairs, and placed parallel to a central area between the discharge portions of each row electrode which are adjacent to each other in the row direction and arranged in accordance with the unit light emission areas. Dielectric additional portions are formed on the rear-facing face of the dielectric layer covering the row electrode pairs, and project from the dielectric layer toward the second substrate and extend in the column direction. Each of the dielectric additional portions is placed parallel to an area between the column electrode and the discharge portion which is located on the opposite side of the dielectric additional portion from the discharge portion serving as a partner of the column electrode for initiating a discharge.

In an exemplified embodiment of such a PDP according to the present invention as described above, row electrode pairs and column electrodes are formed on the front glass substrate, and each of the column electrodes is placed parallel to an area between two adjacent electrode projections of the electrode projections of each row electrode which are arranged in the row direction at regular intervals along an electrode body of the row electrode extending in the row direction. In the PDP, the column electrode is placed in a position, in the column direction, closer to the electrode projection serving as its proper partner for initiating an address discharge than to another electrode projection located on the opposite side of the column electrode from the proper electrode projection. Alternatively, a vertical wall of a partition wall unit, which provides a partition between adjacent discharge cells in the row direction and is placed parallel to the column electrode, is placed in a position, in the row direction, farther away from the electrode projection serving as the proper partner of the column electrode for initiating the address discharge, than from the another electrode projection located on the opposite side of the column electrode. Alternatively, an additional dielectric layer, which extends in the column direction on the rear-facing face of a dielectric layer overlying the row electrode pairs and projections from the rear-facing face of the dielectric layer so as to cover the column electrode, is placed in a position, in the row direction, farther away from the electrode projection serving as the proper partner of the column electrode for initiating the address discharge, than from the another electrode projection located on the opposite side of the column electrode. Still alternatively, an additional dielectric layer, which extends in the column direction on the rear-facing face of a dielectric layer overlying the row electrode pairs and the column electrodes, and projections from the rear-facing face of the dielectric layer, is placed parallel to an area between the column electrode and the unrelated electrode projection located on the opposite side of the column electrode from the electrode projection serving as the proper partner of the column electrode for initiating the address discharge.

In the PDP of the embodiment, when the column electrode is placed closer to the electrode projection serving as the proper partner of the column electrode, the distance between the column electrode and the unrelated electrode projection located on the opposite side of the column electrode is increased, resulting in prevention of a false discharge from occurring the column electrode and the unrelated electrode projection. When the vertical wall of the partition wall unit is placed in a position farther away from the electrode projection serving as the proper partner of the column electrode, the volume of the structural component intervening in a discharge path between the column electrode and the unrelated electrode projection is increased, whereby a discharge does not easily occur between the column electrode and the unrelated electrode projection, resulting in prevention of a false discharge. When the additional dielectric layer is placed in a position closer to the unrelated electrode projection located on the opposite side of the column electrode from the electrode projection serving as the proper partner, the volume of the structural component intervening in a discharge path between the column electrode and the unrelated electrode projection is increased, whereby a discharge does not easily occur between the column electrode and the unrelated electrode projection, resulting in prevention of a false discharge.

These and other objects and features of the present invention will become more apparent from the following detailed description with reference to the accompanying drawings.

DETAILED DESCRIPTION OF THE PREFERRED EMBODIMENTS

First Embodiment Example

Figure 5:
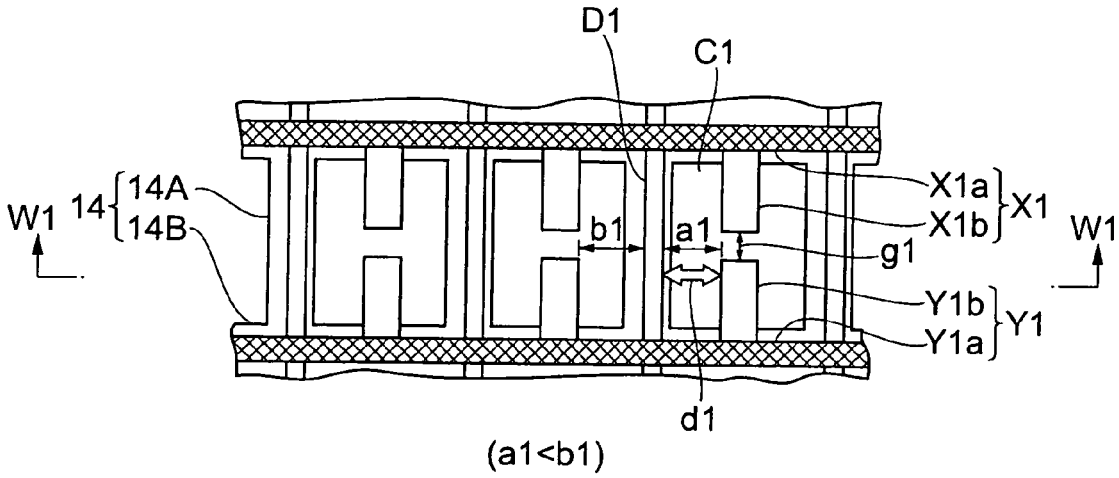
FIG. 5 is a front view illustrating a first example in the embodiment of the PDP according to the present invention.
Figure 6:
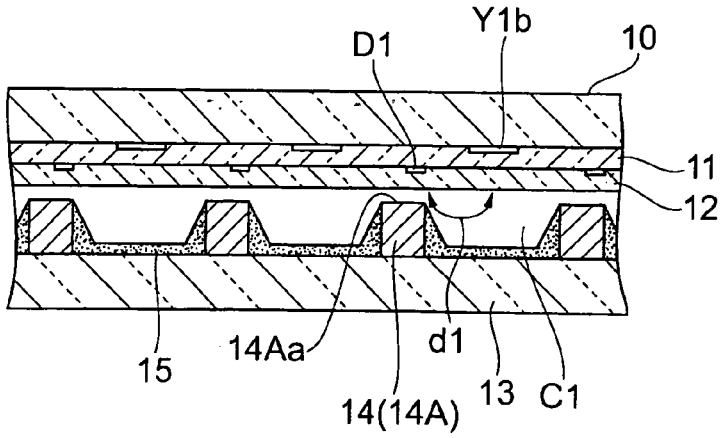
FIG. 6 is a sectional view taken along the W1-W1 line in FIG. 5.

FIGS. 5 and 6 illustrate a first example of the embodiment of the PDP according to the present invention. FIG. 5 is a schematic front view showing the structure of a display line of the PDP in the first embodiment example, and FIG. 6 is a sectional view taken along the W1-W1 line in FIG. 5.

In FIGS. 5 and 6, row electrode pairs (X1, Y1) are formed on a front glass substrate 10 serving as the display surface and extend in the row direction of the front glass substrate 10 (the right-left direction in FIG. 5).

The row electrodes X1 and Y1 are each composed of belt-shaped bus electrodes X1*a*, Y1*a* extending parallel to each other in the row direction and formed of a black- or dark-colored metal film, and a plurality of transparent electrodes X1*b*, Y1*b* which are spaced at regular intervals and connected to the associated bus electrodes X1*a*, Y1*a*, and each extend out from the associated bus electrodes X1*a*, Y1*a* toward their counterparts in the row electrode pair so as to face each other across a discharge gap gi.

A first dielectric layer 11 is formed on the rear-facing face of the front glass substrate 10 and overlies the row electrode pairs (X1, Y1).

On the rear-facing face of the first dielectric layer 11, belt-shaped column electrodes D1 are arranged in parallel at predetermined intervals. Each of the column electrodes D1 extends in a direction at right angles to the row electrode pairs (X1, Y1) (i.e. in the column direction) and parallel to an area around the centerline between the adjacent transparent electrodes X1*b* and also between the adjacent transparent electrodes Y1*b* which are spaced at regularly intervals in the row direction along the associated bus electrodes X1*a*, Y1*a* of the row electrodes X1, Y1.

The arrangement of the column electrodes D1 will be described in detail later.

A second dielectric layer 12 is formed on the rear-facing face of the first dielectric layer 11 so as to overlie the column electrodes D1. Further, an MgO protective layer (not shown) is formed on the rear-facing face of the second dielectric layer 12.

The front glass substrate 10 is placed opposite the back glass substrate 13 with a discharge space in between. An approximate grid-shaped partition wall unit 14 composed of belt-shaped vertical walls 14A and belt-shaped lateral walls 14B is formed on the front-facing face (i.e. the face facing toward the display surface of the PDP) of the back glass substrate 13. Each of the belt-shaped vertical walls 14A extends in the column direction and parallel to the centerline between the adjacent transparent electrodes X1*b* and adjacent transparent electrodes Y1*b* which are arranged at regular intervals in the row direction along the associated bus electrodes X1*a*, Y1*a* of the row electrodes X1, Y1 formed on the front glass substrate 10, and the vertical wall 14A is opposite the column electrode D1. Each of the lateral walls 14B extends in the row direction opposite the bus electrodes X1*a*, Y1*a* of the row electrodes X1, Y1. The partition wall unit 14 partitions the discharge space defined between the front glass substrate 10 and the back glass substrate 13 into areas each corresponding to paired transparent electrodes X1*b* and Y1*b* in each row electrode pair (X1, Y1) to form quadrangular discharge cells C1.

In each discharge cell C1, a phosphor layer 15 covers the five faces: the surface of the back glass substrate 13 and the side faces of the vertical walls 14A and the lateral walls 14B of the partition wall unit 14. The primary colors, red, green and blue are applied to the phosphor layers 15 and arranged in this order in the row direction for the respective discharge cells C1.

The discharge space between the front glass substrate 10 and the back glass substrate 13 is filled with a discharge gas that includes xenon.

In the PDP, the vertical wall 14A of the partition wall unit 14 is opposite to the centerline between adjacent transparent electrodes Y1*b* spaced at regular intervals and connected to the bus electrode Y1*a* of each row electrode Y1 as described earlier.

Although the column electrode D1 is opposite to the vertical wall 14A of the partition wall unit 14, the position of the column electrode D1 is offset within the range of the row-direction width of the top face 14Aa of the vertical wall 14A placed parallel to the front glass substrate 10, such that the column electrode D1 is positioned closer to the corresponding discharge cell C1, that is, the discharge cell C1 which the transparent electrode Y1*b* serving as the proper partner of the column electrode D1 for initiating an address discharge faces (a discharge cell C1 positioned on the right-hand side of each column electrode D1 in the example of FIG. 5), than to another discharge cell C1 which is adjacent to the same discharge cell C1 with the vertical wall 14A in between (a discharge cell C1 positioned on the left-hand side of each column electrode D1 in the example in FIG. 5).

The foregoing PDP initiates an address discharge d1 between the column electrode D1 to which a data pulse is selectively applied and the transparent electrode Y1*b* (located on the right side of the column electrode D1 in FIG. 5) of the row electrode Y1 to which a scan pulse is applied, in the address period when the PDP is driven. As a result of the address discharge d1, a wall charge is generated on the portions of the first dielectric layer 11 and the second dielectric layer 12 facing the discharge cell C1 in which the address discharge d1 is produced (or the wall charge deposited is erased).

At this point, the address discharge d1 is readily initiated between the column electrode D1 and the transparent electrode Y1*b* of its proper partner, and also the occurrence of a false discharge between the column electrode D1 and another transparent electrode Y1*b* adjacent thereto on the other side is prevented. This is because, as described above, the column electrode D1 is disposed in an offset position closer to the discharge cell C1 for initiating the address discharge within the range opposite the top face 14Aa of the vertical wall 14A, so that the distance a1 between the column electrode D1 and the transparent electrode Y1*b* which is the partner for initiating the address discharge is shorter than the distance b1 between the column electrode and another transparent electrode Y1*b* positioned on the other side of the column electrode D1.

Figure 1:
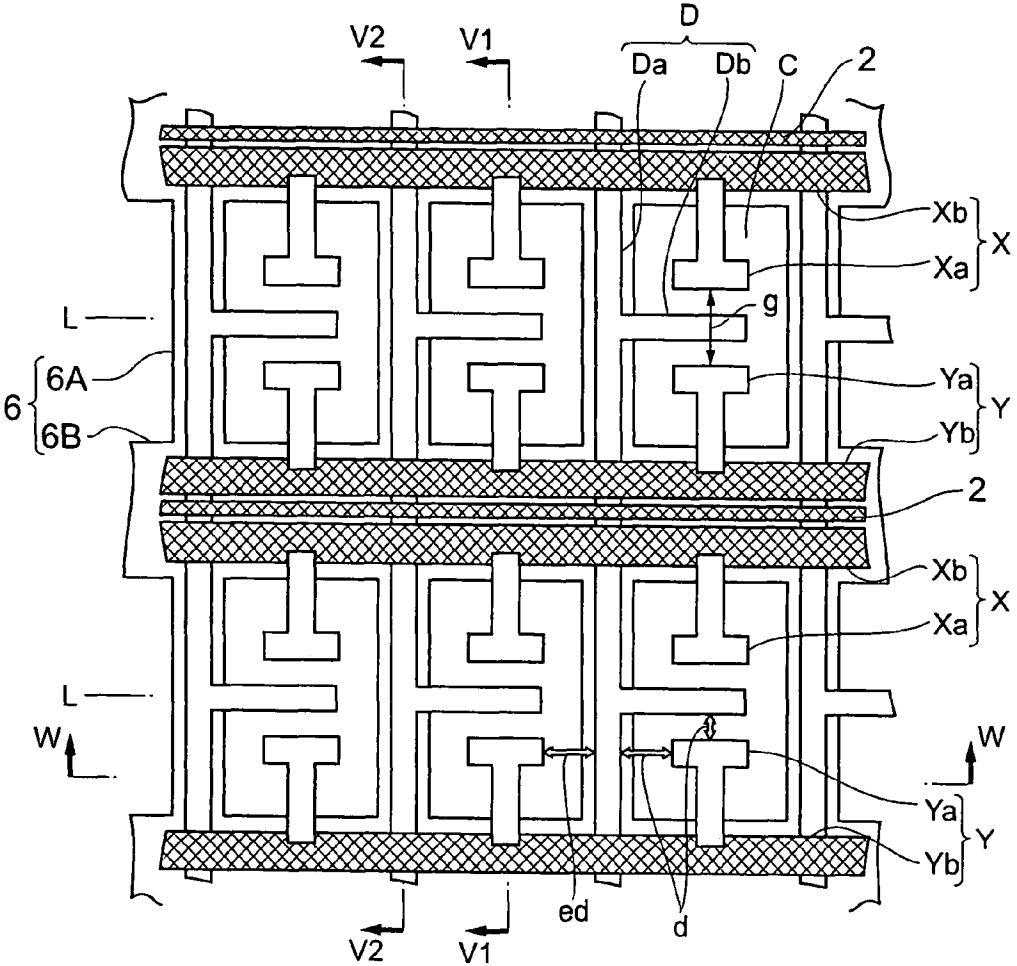
Fig.1 RELATED ART
FIG. 1 is a front view partially showing the structure of a conventional PDP.
Figure 2:
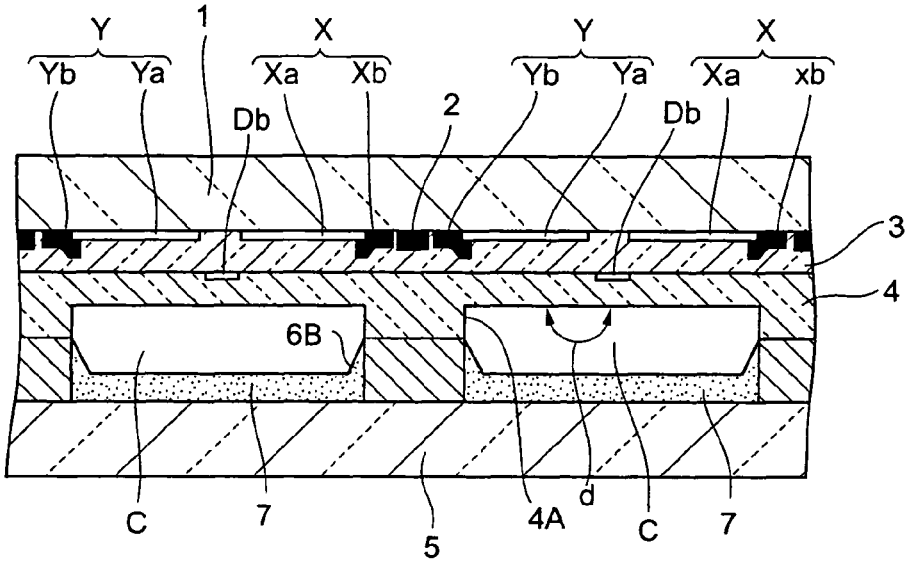
Fig.2 RELATED ART
FIG. 2 is a sectional view taken along the V1-V1 line in FIG. 1.
Figure 3:
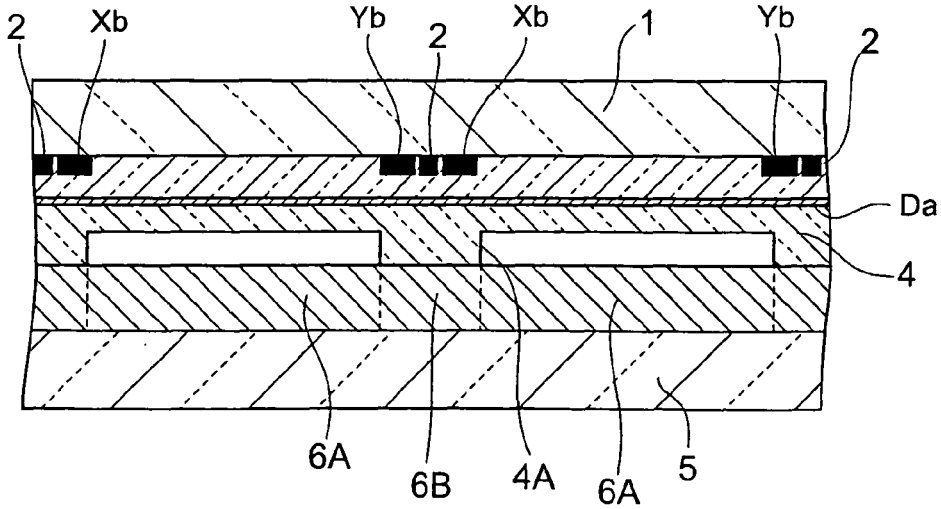
Fig.3 RELATED ART
FIG. 3 is a sectional view taken along the V2-V2 line in FIG. 1.
Figure 4:
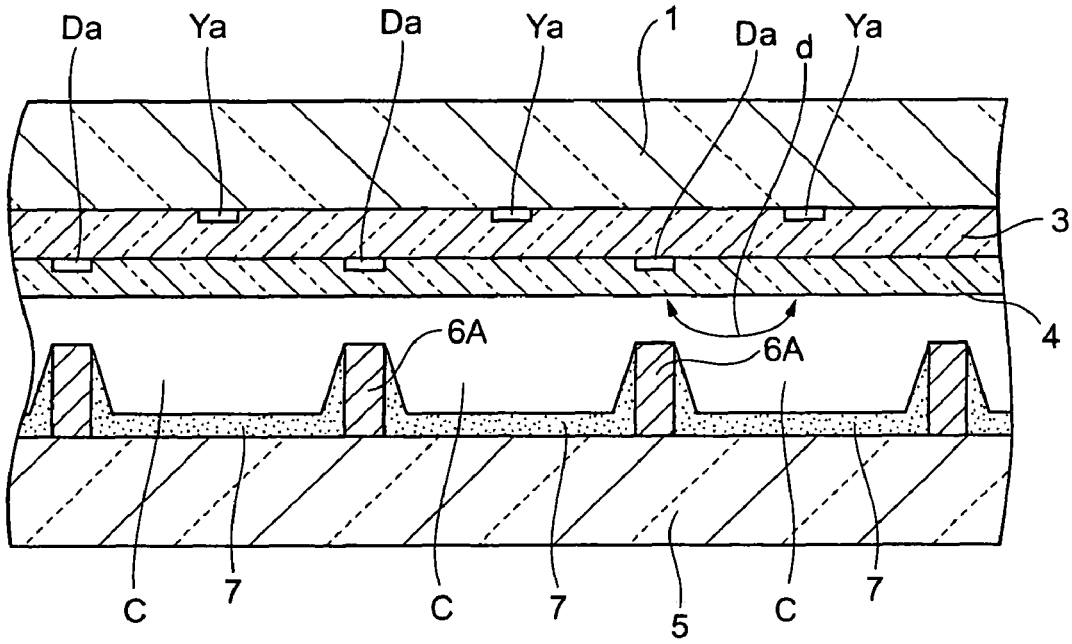
Fig.4 RELATED ART
FIG. 4 is a sectional view taken along the W-W line in FIG. 1.

The foregoing has described the case when each of the transparent electrodes X1*b* and Y1*b* of the row electrodes X1 and Y1 is formed in a belt shape, but a transparent electrode may be formed in an approximate T shape as illustrated in the example of FIG. 1.

The foregoing has described the case when the column electrode D1 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

Second Embodiment Example

Figure 7:
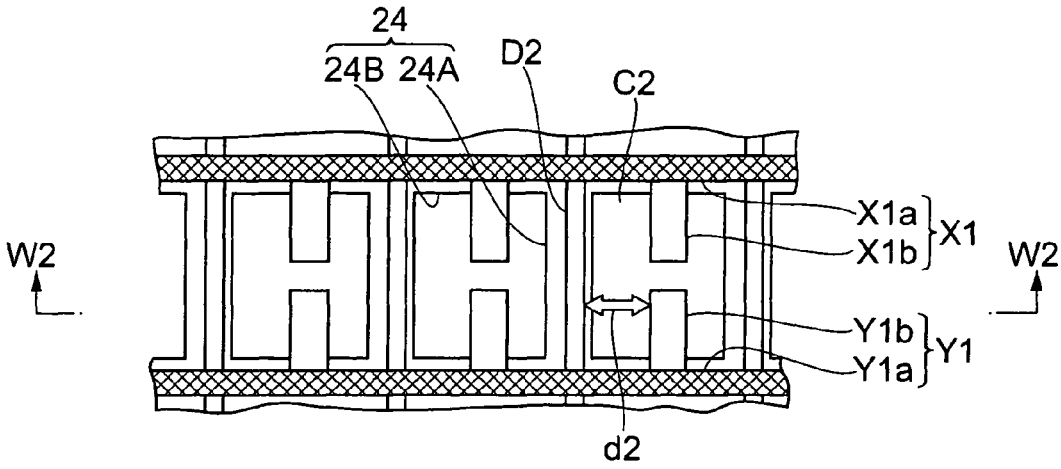
FIG. 7 is a front view illustrating a second example of the embodiment of the PDP according to the present invention.
Figure 8:
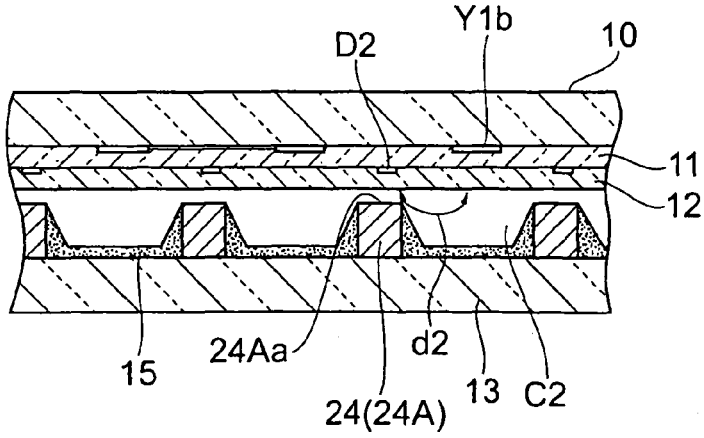
FIG. 8 is a sectional view taken along the W2-W2 line in FIG. 7.

FIGS. 7 and 8 illustrate a second example of the embodiment of the PDP according to the present invention. FIG. 7 is a schematic front view showing the structure of a display line of the PDP in the second embodiment example, and FIG. 8 is a sectional view taken along the W2-W2 line in FIG. 7.

In FIGS. 7 and 8, column electrodes D2 are formed on the rear-facing face of the first dielectric layer 11. Each of the column electrodes D2 extends in the column direction and parallel to the centerline between the adjacent transparent electrodes X1*b* and adjacent transparent electrodes Y1*b* which are spaced at regular intervals in the row direction along the associated bus electrodes X1*a*, Y1*a* of the row electrodes X1, Y1.

The structure of the other components provided on the front glass substrate 10 in the second embodiment example is approximately the same as that in the PDP of the first embodiment example, and the same components are designated by the same reference numerals in FIGS. 7 and 8 as those in FIGS. 5 and 6.

An approximate grid-shaped partition wall unit 24 composed of belt-shaped vertical walls 24A and belt-shaped lateral walls 24B is formed on the front-facing face of the back glass substrate 13 placed opposite the front glass substrate 10 with a discharge space in between. Each of the belt-shaped vertical walls 24A extends in the column direction and parallel to an area around the centerline between the adjacent transparent electrodes X1*b* and also between the adjacent transparent electrodes Y1*b* which are regularly spaced in the row direction along the associated bus electrodes X1*a*, Y1*a* of the row electrodes X1, Y1 formed on the front glass substrate 10, and the vertical wall 24A is placed opposite the column electrode D2. Each of the lateral walls 24B extends in the row direction opposite the bus electrodes X1*a*, Y1*a* of the row electrodes X1, Y1. The partition wall unit 24 partitions the discharge space defined between the front glass substrate 10 and the back glass substrate 13 into areas each corresponding to paired transparent electrodes X1*b* and Y1*b* in each row electrode pair (X1, Y1) to form quadrangular discharge cells C2.

The position of the vertical wall 24A of the partition wall unit 24 will be described in detail later.

In each discharge cell C2, the phosphor layer 15 covers the five faces: the surface of the back glass substrate 13 and the side faces of the vertical walls 24A and the lateral walls 24B of the partition wall unit 24. The primary colors, red, green and blue are applied to the phosphor layers 15 and arranged in this order in the row direction for the respective discharge cells C2.

The discharge space between the front glass substrate 10 and the back glass substrate 13 is filled with a discharge gas that includes xenon.

In the PDP, the column electrode D2 is positioned parallel to the centerline between adjacent transparent electrodes Y1*b* which are regularly spaced and connected to the bus electrode Y1*a* of each row electrode Y1, and the vertical wall 24A of the partition wall unit 24 is placed opposite to the column electrode D2 as described earlier.

A top face 24Aa of the vertical wall 24A disposed parallel to the front glass substrate 10 is opposite the column electrode D2 within the range of the row-direction width of the top face 24Aa. In addition, the vertical wall 24A of the partition wall unit 24 is in an offset position closer to the unrelated transparent electrode Y1*b* situated on the other side of the column electrode D2 (the transparent electrode Y1*b* positioned on the left-hand side of each column electrode D2 in the example in FIG. 7) than to the transparent electrode Y1*b* serving as a proper partner of the column electrode D2 opposite the top face 24Aa for initiating an address discharge (the transparent electrode Y1*b* positioned on the right-hand side of each column electrode D2 in the example of FIG. 7).

The foregoing PDP initiates an address discharge d2 between the column electrode D2 to which a data pulse is selectively applied and the transparent electrode Y1*b* (located on the right side of the column electrode D2 in FIG. 7) of the row electrode Y1 to which a scan pulse is applied, in the address period when the PDP is driven. As a result of the address discharge d2, a wall charge is generated on the portions of the first dielectric layer 11 and the second dielectric layer 12 facing the discharge cell C2 in which the address discharge d2 is produced (or the wall charge deposited is erased).

At this point, the occurrence of a false discharge between the column electrode D2 and the unrelated transparent electrode Y1*b* is prevented. This is because, as described above, the vertical wall 24A of the partition wall unit 24 is located in the offset position farther away from the transparent electrode Y1*b* serving as the proper partner of the column electrode D2 for initiating the address discharge within the range in which the column electrode D2 is opposite the top face 24Aa. For this reason, the volume of the structural component of the PDP (a part of the vertical wall 24A in this case) intervening in a discharge path when a discharge occurs between the column electrode D2 and the unrelated transparent electrode Y1*b* disposed on the opposite side from the transparent electrode Y1*b* serving as the proper partner of the column electrode D2 is larger than the volume of the structural component intervening in a discharge path between the column electrode D2 and the proper transparent electrode Y1*b*.

The foregoing has described the case when each of the transparent electrodes X1*b* and Y1*b* of the row electrodes X1 and Y1 is formed in a belt shape, but a transparent electrode may be formed in an approximate T shape as illustrated in the example of FIG. 1.

The foregoing has described the case when the column electrode D2 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

Third Embodiment Example

Figure 9:
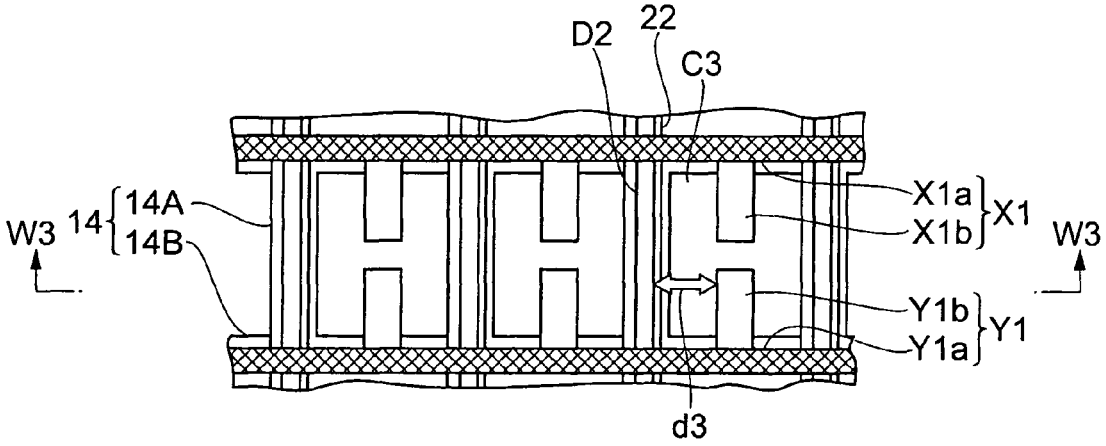
FIG. 9 is a front view illustrating a third example of the embodiment of the PDP according to the present invention.
Figure 10:
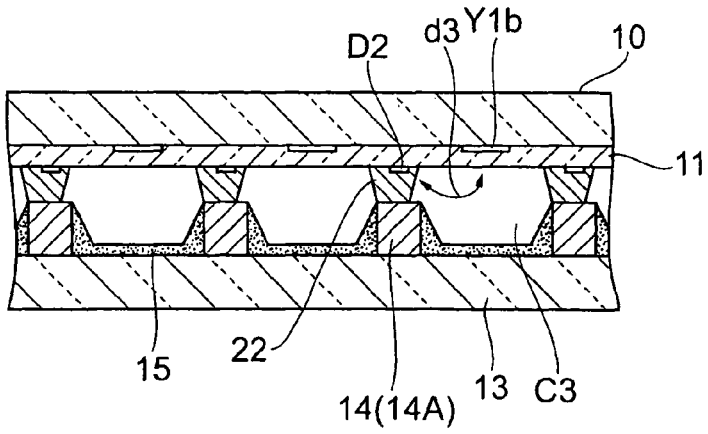
FIG. 10 is a sectional view taken along the W3-W3 line in FIG. 9.

FIGS. 9 and 10 illustrate a third example in the embodiment of the PDP according to the present invention. FIG. 9 is a schematic front view showing the structure of a display line of the PDP in the third embodiment example, and FIG. 10 is a sectional view taken along the W3-W3 line in FIG. 9.

In FIGS. 9 and 10, the column electrodes D2 are formed on the rear-facing face of the first dielectric layer 11. Each of the column electrodes D2 extends in the column direction and parallel to the centerline between the adjacent transparent electrodes X1*b* and adjacent transparent electrodes Y1*b* which are regularly spaced in the row direction along the associated bus electrodes X1*a*, Y1*a* of the row electrodes X1, Y1.

The above structure is approximately the same as that in the PDP of the second embodiment example and the same components are designated by the same reference numerals.

Additional dielectric layers 22 project from the rear-facing face of the first dielectric layer 11 toward the rear of the PDP. Each of the additional dielectric layers 22 extends in the column direction along a portion of the first dielectric layer 11 opposite to an area around the centerline between the adjacent transparent electrodes X1*b* and also between the adjacent transparent electrodes Y1*b* which are regularly spaced in the row direction along the associated bus electrodes X1*a* and Y1*a* of the row electrodes X1, Y1. The column electrodes D2 are overlain by the respective additional dielectric layers 22.

The position of the additional dielectric layer 22 will be described in detail later.

An approximate grid-shaped partition wall unit 14 composed of belt-shaped vertical walls 14A and belt-shaped lateral walls 14B is formed on the front-facing face of the back glass substrate 13 placed opposite the front glass substrate 10 with the discharge space in between. Each of the belt-shaped vertical walls 14A extends in the column direction and parallel to the centerline between the adjacent transparent electrodes X1*b* and also between the adjacent transparent electrodes Y1*b* which are arranged at regular intervals in the row direction along the associated bus electrodes X1*a*, Y1*a* of the row electrodes X1, Y1 formed on the front glass substrate 10, so as to be placed opposite the column electrode D2. Each of the lateral walls 14B extends in the row direction opposite the bus electrodes X1*a*, Y1*a* of the row electrodes X1, Y1. The partition wall unit 14 partitions the discharge space defined between the front glass substrate 10 and the back glass substrate 13 into areas each corresponding to paired transparent electrodes X1*b* and Y1*b* in each row electrode pair (X1, Y1) to form quadrangular discharge cells C3.

The above structure and the structure of the other components on the back glass substrate 13 are approximately the same as those in the PDP of the first embodiment example, and the same components are designated by the same reference numerals in FIGS. 9 and 10 as those in FIGS. 5 and 6.

In the PDP of the third embodiment example, the column electrode D2 is placed in a position parallel to the middle between adjacent transparent electrodes Y1*b* which are regularly spaced and connected to the bus electrode Y1*a* of each row electrode Y1, and the vertical wall 14A of the partition wall unit 14 is placed opposite to the column electrode D2, as described earlier.

The additional dielectric layer 22 overlying the column electrode D2 is, in FIGS. 9 and 10, in an offset position closer to the unrelated transparent electrode Y1*b* which is situated on the other side of the column electrode D2 (the transparent electrode Y1*b* positioned on the left-hand side of each column electrode D2 in the example in FIG. 9) than to the transparent electrode Y1*b* serving as a proper partner of the column electrode D2 for initiating an address discharge (the transparent electrode Y1*b* positioned on the right-hand side of each column electrode D2 in the example of FIG. 9).

Each of the additional dielectric layers 22 is in contact with the corresponding vertical wall 14A of the partition wall unit 14.

The foregoing PDP initiates an address discharge d3 between the column electrode D2 to which a data pulse is selectively applied and the transparent electrode Y1*b* (located on the right side of the column electrode D2 in FIG. 9) of the row electrode Y1 to which a scan pulse is applied, in the address period when the PDP is driven. As a result of the address discharge d3, a wall charge is generated on the portions of the first dielectric layer 11 facing the discharge cell C3 in which the address discharge d3 is produced (or the wall charge deposited is erased).

At this point, the occurrence of a false discharge between the column electrode D2 and the unrelated transparent electrode Y1*b* is prevented. This is because, as described above, the additional dielectric layer 22 overlying the column electrode D2 is located in the offset position farther away from the transparent electrode Y1*b* serving as the proper partner of the column electrode D2 for initiating the address discharge. For this reason, the volume of the structural component of the PDP (a part of the additional dielectric layer 22 in this case) intervening in a discharge path when a discharge occurs between the column electrode D2 and the unrelated transparent electrode Y1*b* disposed on the other side of the column electrode D2 is larger than the volume of the structural component intervening in a discharge path between the column electrode D2 and the proper transparent electrode Y1*b*.

The foregoing has described the case when each of the transparent electrodes X1*b* and Y1*b* of the row electrodes X1 and Y1 is formed in a belt shape, but a transparent electrode may be formed in an approximate T shape as illustrated in the example of FIG. 1.

The foregoing has described the case when the column electrode D2 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

Fourth Embodiment Example

Figure 11:
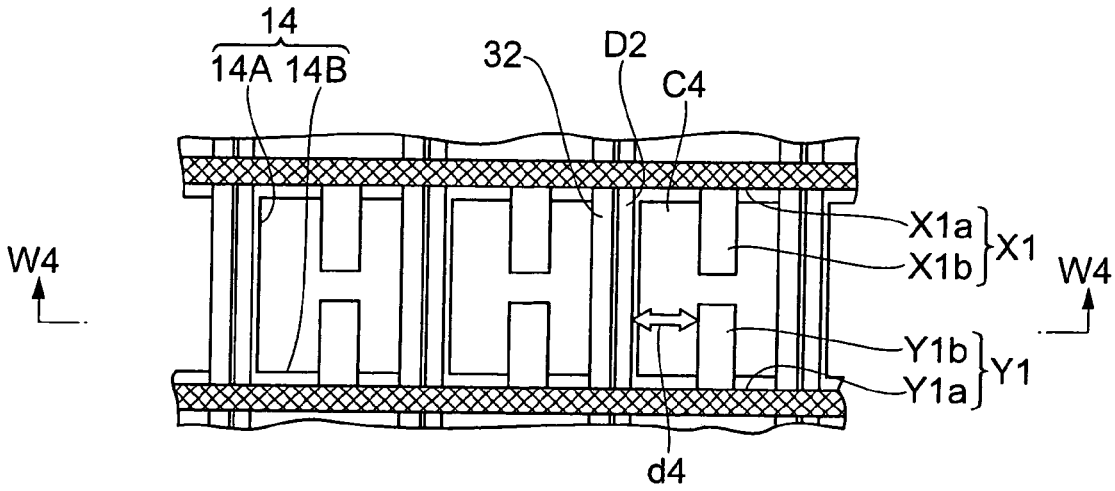
FIG. 11 is a front view illustrating a fourth example of the embodiment of the PDP according to the present invention.
Figure 12:
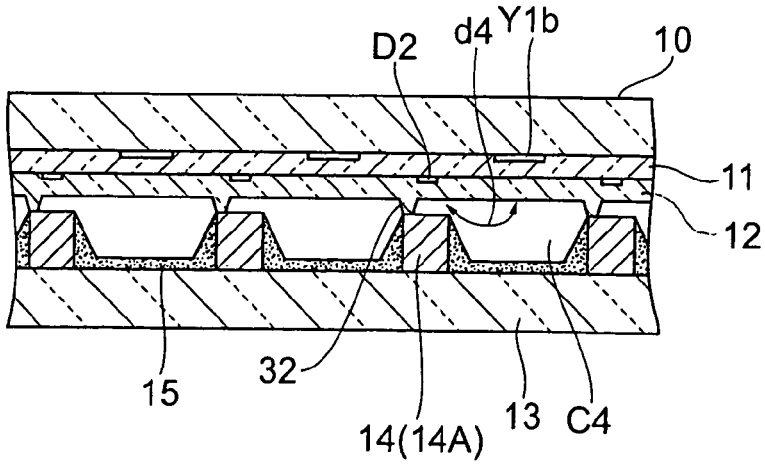
FIG. 12 is a sectional view taken along the W4-W4 line in FIG. 11.

FIGS. 11 and 12 illustrate a fourth example in the embodiment of the PDP according to the present invention. FIG. 11 is a schematic front view showing the structure of a display line of the PDP in the fourth embodiment example, and FIG. 12 is a sectional view taken along the W4-W4 line in FIG. 11.

In FIGS. 11 and 12, each of the column electrodes D2 formed on the rear-facing face of the first dielectric layer 11 extends in the column direction and parallel to the centerline between the adjacent transparent electrodes X1*b* and also between the adjacent transparent electrodes Y1*b* which are regularly spaced in the row direction along the associated bus electrodes X1*a*, Y1*a* of the row electrodes X1, Y1. The second dielectric layer 12 overlies the column electrodes D2.

The above structure is approximately the same as that in the PDP of the second embodiment example and the same components are designated by the same reference numerals.

Additional dielectric layers 32 project from the rear-facing face of the second dielectric layer 12, and each extend in the column direction and parallel to an area around the centerline between the adjacent transparent electrodes X1*b* and also between the adjacent transparent electrodes Y1*b* which are regularly spaced in the row direction along the associated bus electrodes X1*a* and Y1*a* of the row electrodes X1, Y1.

The position of the additional dielectric layer 32 will be described in detail later.

The approximate grid-shaped partition wall unit 14 made up of vertical walls 14A and lateral walls 14B is formed on the front-facing face of the back glass substrate 13 placed opposite the front glass substrate 10 with the discharge space in between. The partition wall unit 14 partitions the discharge space defined between the front glass substrate 10 and the back glass substrate 13 into areas each corresponding to paired transparent electrodes X1*b* and Y1*b* in each row electrode pair (X1, Y1) to form quadrangular discharge cells C4.

The above structure and the structure of the other components on the back glass substrate 13 are approximately the same as those in the PDP of the first embodiment example, and the same components are designated by the same reference numerals in FIGS. 11 and 12 as those in FIGS. 5 and 6.

In the PDP of the fourth embodiment example, the column electrode D2 is opposite to the centerline between adjacent transparent electrodes Y1*b* regularly spaced and connected to the bus electrode Y1*a* of each row electrode Y1, and the vertical wall 14A of the partition wall unit 14 is placed opposite to the column electrode D2, as described earlier.

The additional dielectric layer 32 projecting from the rear-facing face of the second dielectric layer 12 toward the back glass substrate 13 is, in FIGS. 11 and 12, in an offset position closer to the unrelated transparent electrode Y1*b* situated on the other side of the column electrode D2 (the transparent electrode Y1*b* positioned on the left-hand side of each column electrode D2 in the example in FIG. 11) than to the transparent electrode Y1*b* serving as a proper partner of the column electrode D2 for initiating an address discharge (the transparent electrode Y1*b* positioned on the right-hand side of each column electrode D2 in the example of FIG. 11).

Each of the additional dielectric layers 32 is in contact with the corresponding vertical wall 14A of the partition wall unit 14.

The foregoing PDP initiates an address discharge d4 between the column electrode D2 to which a data pulse is selectively applied and the transparent electrode Y1*b* (located on the right side of the column electrode D2 in FIG. 11) of the row electrode Y1 to which a scan pulse is applied, in the address period when the PDP is driven. As a result of the address discharge d4, a wall charge is generated on the portions of the first dielectric layer 11 and the second dielectric layer 12 facing the discharge cell C4 in which the address discharge d4 is produced (or the wall charge deposited is erased).

At this point, the occurrence of a false discharge between the column electrode D2 and the unrelated transparent electrode Y1*b* is prevented. This is because, as described above, the additional dielectric layer 32 is located in the offset position father away from the transparent electrode Y1*b* serving as the proper partner of the column electrode D2 for initiating the address discharge. For this reason, the volume of the structural component of the PDP (a part of the additional dielectric layer 32 in this case) intervening in a discharge path when a discharge occurs between the column electrode D2 and the unrelated transparent electrode Y1*b* disposed on the other side of the column electrode D2 from the proper transparent electrode Y1*b* is larger than the volume of a structural component intervening in a discharge path between the column electrode D2 and the proper transparent electrode Y1*b*.

The foregoing has described the case when each of the transparent electrodes X1*b* and Y1*b* of the row electrodes X1 and Y1 is formed in a belt shape, but a transparent electrode may be formed in an approximate T shape as illustrated in the example of FIG. 1.

The foregoing has described the case when the column electrode D2 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

Fifth Embodiment Example

Figure 13:
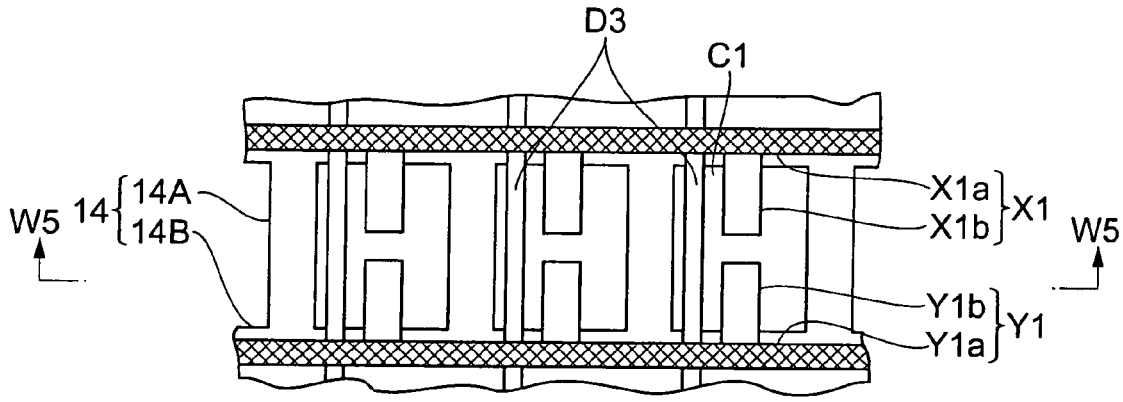
FIG. 13 is a front view illustrating a fifth example of the embodiment of the PDP according to the present invention.
Figure 14:
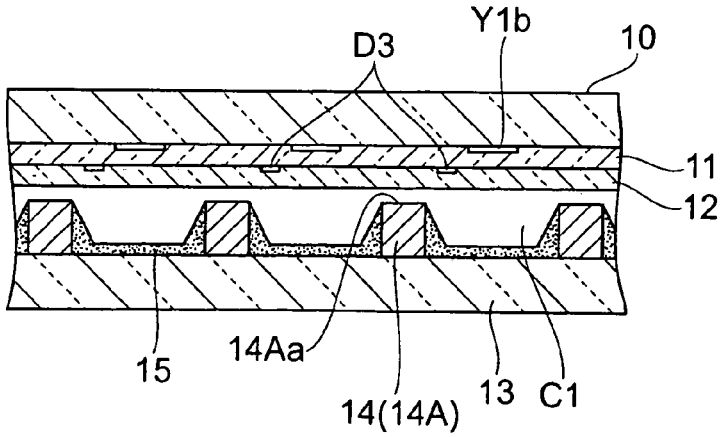
FIG. 14 is a sectional view taken along the W5-W5 line in FIG. 13.

FIGS. 13 and 14 illustrate a fifth example of the embodiment of the PDP according to the present invention. FIG. 13 is a schematic front view showing the structure of a display line of the PDP in the fifth embodiment example, and FIG. 14 is a sectional view taken along the W5-W5 line in FIG. 13.

The column electrode in the first embodiment example illustrated in FIGS. 5 and 6 is placed in the offset position closer to the transparent electrode serving as its proper partner for initiating the address discharge, within the range of its being opposite to the vertical wall of the partition wall unit. By contrast, column electrodes D3 in the PDP of the fifth embodiment example are each disposed in an offset position closer to the transparent electrode Y1*b* serving as its proper partner for initiating an address discharge (toward the right hand in FIGS. 13 and 14) with respect to the vertical wall 14A within the range of its facing the discharge cell C1 which the transparent electrode Y1*b* serving as the partner for the initiation of the address discharge faces.

Each of the column electrodes D3 may be placed completely outside the range of its being opposite to the top face 14Aa of the vertical wall 14A of the partition wall 14 as illustrated in FIGS. 13 and 14, or alternatively placed partially opposite to the top face 14Aa of the vertical wall 14A.

The structure of the other components in the fifth embodiment example is approximately the same as that in the case of the first embodiment example and the same structural components as those in the first embodiment example are designated with the same reference numerals in FIGS. 13 and 14 as those in FIGS. 5 and 6.

In the above PDP, an address discharge between the column electrode D3 and the proper transparent electrode Y1*b* occurs more readily than that in the case of the first embodiment example, and also the occurrence of a false discharge between the column electrode D3 and another transparent electrode Y1*b* adjacent thereto on the other side is prevented. This is because the column electrode D3 is situated in the offset position near the transparent electrode Y1*b* which serves as its partner for the initiation of an address discharge, and facing the discharge cell C1 in which an address discharge is to be initiated, so that the distance between the column electrode D3 and the transparent electrode Y1*b* which is its proper partner for initiating the address discharge is shorter than the distance between the column electrode D3 and another transparent electrode Y1*b* positioned on the other side of the column electrode D3.

The foregoing has described the case when each of the transparent electrodes X1*b* and Y1*b* of the row electrodes X1 and Y1 is formed in a belt shape, but a transparent electrode may be formed in an approximate T shape as illustrated in the example of FIG. 1.

The foregoing has described the case when the column electrode D3 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

Sixth Embodiment Example

Figure 15:
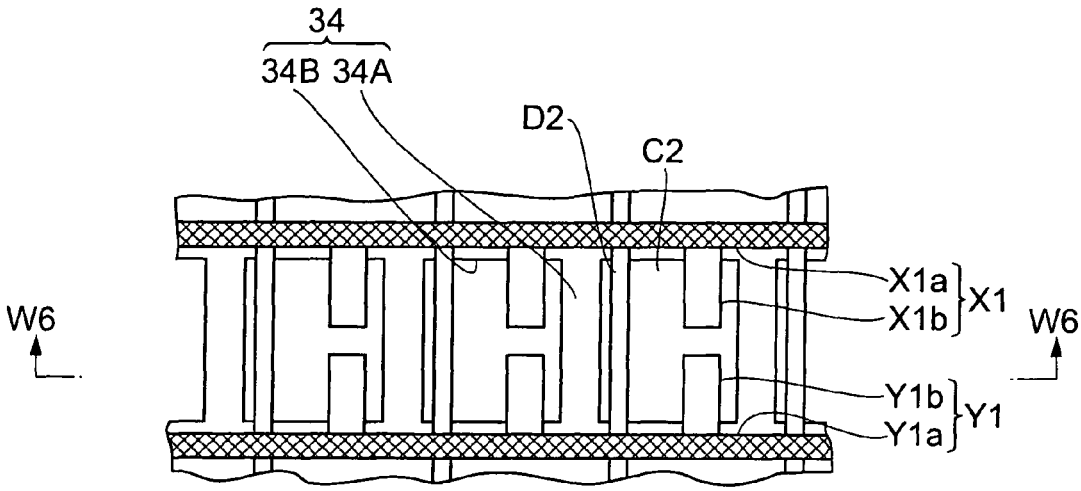
FIG. 15 is a front view illustrating a sixth example of the embodiment of the PDP according to the present invention.
Figure 16:
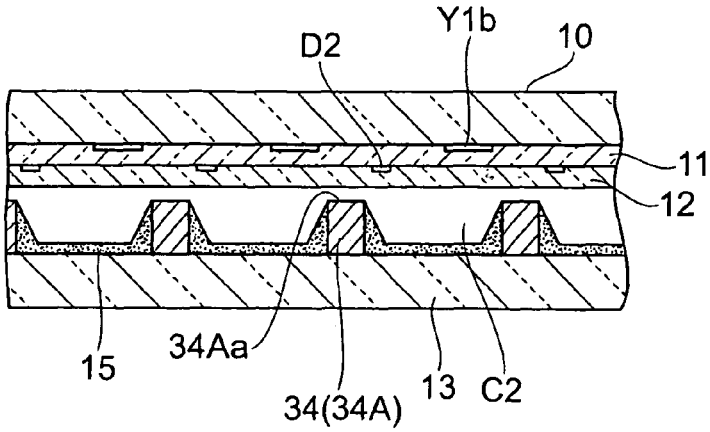
FIG. 16 is a sectional view taken along the W6-W6 line in FIG. 15.

FIGS. 15 and 16 illustrate a sixth example of the embodiment of the PDP according to the present invention. FIG. 15 is a schematic front view showing the structure of a display line of the PDP in the sixth embodiment example, and FIG. 16 is a sectional view taken along the W6-W6 line in FIG. 15.

The vertical wall of the partition wall unit in the second embodiment example illustrated in FIGS. 7 and 8 is placed in the offset position closer to the unrelated transparent electrode located on the opposite side of the vertical wall from the transparent electrode which serves as the proper partner of the column electrode opposite the vertical wall for initiating the address discharge, within the range in which the vertical wall is opposite the column electrode. By contrast, vertical walls 34A of a partition wall unit 34 in the PDP of the sixth embodiment example are each placed in an offset position lying outside the range in which each vertical wall 34A is opposite to the column electrode D2, and the offset position closer to the transparent electrode Y1*b* (the transparent electrode Y1*b* on the left side of each column electrode D2 in FIGS. 15 and 16) which is located on the opposite side of the vertical wall 34A from the transparent electrode Y1*b* serving as a proper partner of the column electrode D2 for initiating an address discharge.

The top face 34Aa of the vertical wall 34A of the partition wall unit 34 may be placed completely outside the range of its being opposite to the column electrode D2 as illustrated in FIGS. 15 and 16, or alternatively placed partially opposite to the column electrode D2.

The structure of the other components in the sixth embodiment example is approximately the same as that in the case of the second embodiment example and the same structural components as those in the second embodiment example are designated by the same reference numerals in FIGS. 15 and 16 as those in FIGS. 7 and 8.

In the above PDP, a discharge between the column electrode D2 and the transparent electrode Y1*b* of its proper partner occurs more readily than that in the case of the second embodiment example, and also the occurrence of a false discharge between the column electrode D2 and another transparent electrode Y1*b* located on the other side of the column electrode D2 is prevented. This is because the vertical wall 34A of the partition wall unit 34 is placed in the offset position lying outside the range in which the top face 34Aa of the vertical wall 34A is opposite the column electrode D2 and closer to the transparent electrode Y1*b* which is located on the opposite side from the transparent electrode Y1*b* serving as the partner of the column electrode D2 for initiating the address discharge. Hence, the volume of the structure of the PDP (the vertical wall 34A in this case) which intervenes in the discharge path when a discharge is initiated between the column electrode D2 and the unrelated transparent electrode Y1*b* located on the opposite side from the transparent electrode Y1*b* serving as the proper partner is increased, and the portion of the partition wall unit 34 intervening in a discharge path between the column electrode D2 and the transparent electrode Y1*b* of its proper partner is eliminated.

The foregoing has described the case when each of the transparent electrodes X1*b* and Y1*b* of the row electrodes X1 and Y1 is formed in a belt shape, but a transparent electrode may be formed in an approximate T shape as illustrated in the example of FIG. 1.

The foregoing has described the case when the column electrode D2 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

Seventh Embodiment Example

Figure 17:
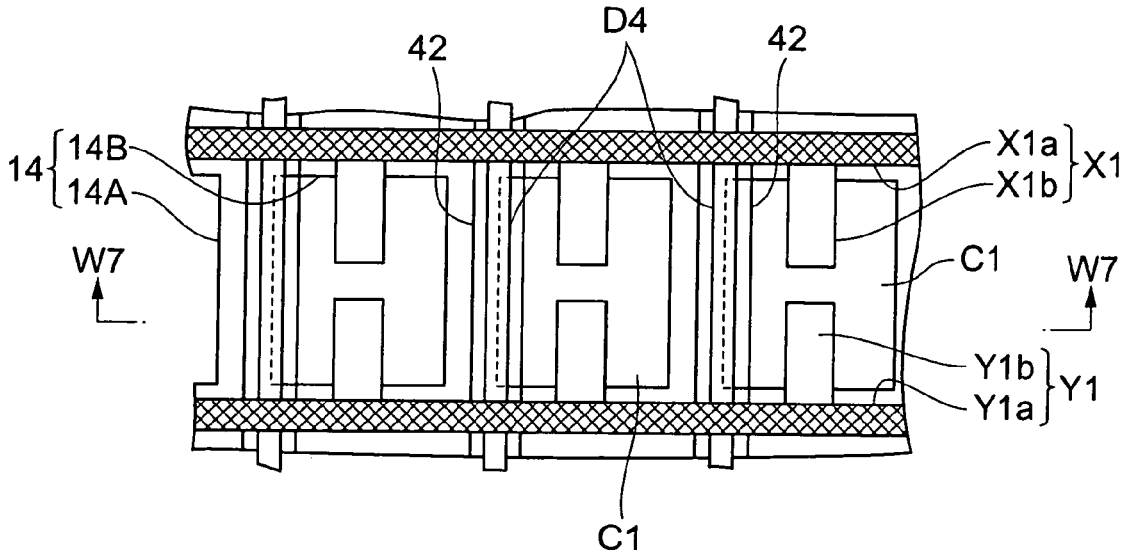
FIG. 17 is a front view illustrating a seventh example of the embodiment of the PDP according to the present invention.
Figure 18:
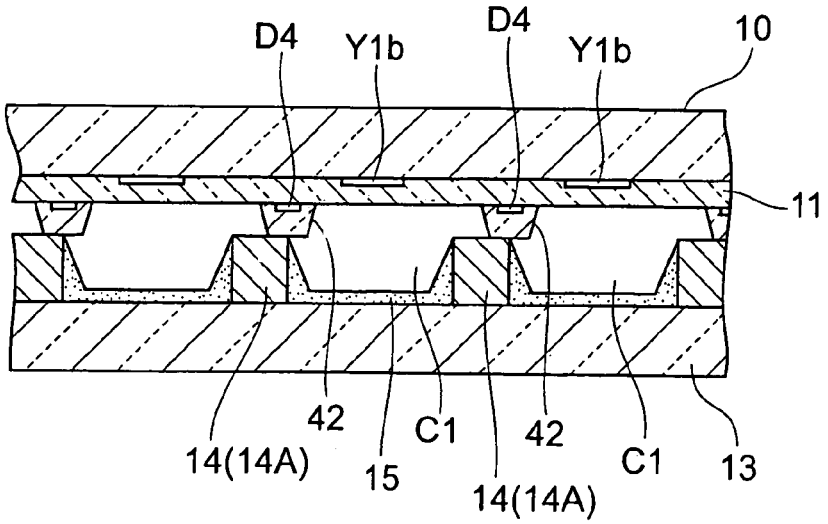
FIG. 18 is a sectional view taken along the W7-W7 line in FIG. 17.

FIGS. 17 and 18 illustrate a seventh example of the embodiment of the PDP according to the present invention. FIG. 17 is a schematic front view showing the structure of a display line of the PDP in the seventh embodiment example, and FIG. 18 is a sectional view taken along the W7-W7 line in FIG. 17.

The column electrode in the first embodiment example illustrated in FIGS. 5 and 6 is placed in the offset position closer to the transparent electrode serving as its proper partner for initiating the address discharge, within the range of its being opposite to the vertical wall of the partition wall unit. By contrast, column electrodes D4 in the PDP of the seventh embodiment example are each placed in an offset position closer to the transparent electrode Y1*b* serving as its proper partner for initiating an address discharge than to the unrelated transparent electrode Y1*b* located on the opposite side, with respect to the vertical wall 14A of the partition wall unit 14 (i.e. closer to the transparent electrode Y1*b* on the right-hand side of the column electrode D4 in FIGS. 17 and 18). Also, the column electrode D4 is placed such that its left edge faces the vertical wall 14A and its right edge faces the discharge cell C1 which the transparent electrode Y1*b* serving as its partner for initiating an address discharge faces, when viewed from the front glass substrate 10.

Additional dielectric layers 42 are formed on the rear-facing face of the first dielectric layer 11 overlying the row electrode pairs (X1, Y1). Each of the additional dielectric layers 42 extends in the column direction and projects from the rear-facing face of the first dielectric layer 11 so as to overlie the column electrode D4.

As in the case of the column electrode D4, the additional dielectric layer 42 is disposed in an offset position closer to the transparent electrode Y1*b* serving as the proper partner of the column electrode D4 for initiating an address discharge (i.e. on the right-hand side in FIGS. 17 and 18). Further, the left edge portion of the additional dielectric layer 42 is in contact with the vertical wall 14A and its right edge portion is placed in the discharge cell C1 facing the transparent electrode Y1*b* serving as the partner of the column electrode D4 for initiating an address discharge, when viewed from the front glass substrate 10.

The structure of the other components in the seventh embodiment example is approximately the same as that in the case of the first embodiment example and the same structural components as those in the first embodiment example are designated by the same reference numerals in FIGS. 17 and 18 as those in FIGS. 5 and 6.

In the above PDP, an address discharge between the column electrode D4 and the proper transparent electrode Y1*b* occurs more readily, and thus occurrence of a false discharge between the column electrode D4 and the unrelated transparent electrode Y1*b* adjacent thereto on the other side is correspondingly prevented. This is because a part of the column electrode D4 is placed in such a manner as to jut out from the position opposite the vertical wall 14A into the discharge cell C1 in which an address discharge is to be initiated, so that the distance between the column electrode D4 and the transparent electrode Y1*b* which is its proper partner for initiating the address discharge is shorter than the distance between the column electrode D4 and the unrelated transparent electrode Y1*b* positioned on the other side of the column electrode D4. In addition, the volume of the structure intervening between the column electrode D4 and the transparent electrode Y1*b* of its proper partner for initiating an address discharge is smaller than in the case of the first embodiment example.

The foregoing has described the case when each of the transparent electrodes X1*b* and Y1*b* of the row electrodes X1 and Y1 is formed in a belt shape, but a transparent electrode may be formed in an approximate T shape as illustrated in the example of FIG. 1.

The foregoing has described the case when the column electrode D4 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

Eighth Embodiment Example

Figure 19:
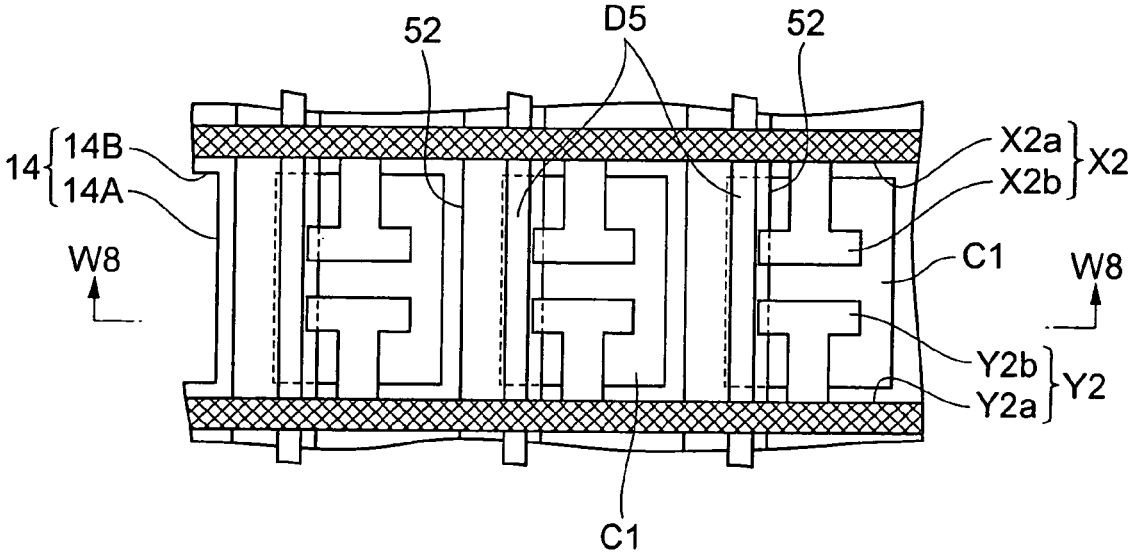
FIG. 19 is a front view illustrating an eighth example of the embodiment of the PDP according to the present invention.
Figure 20:
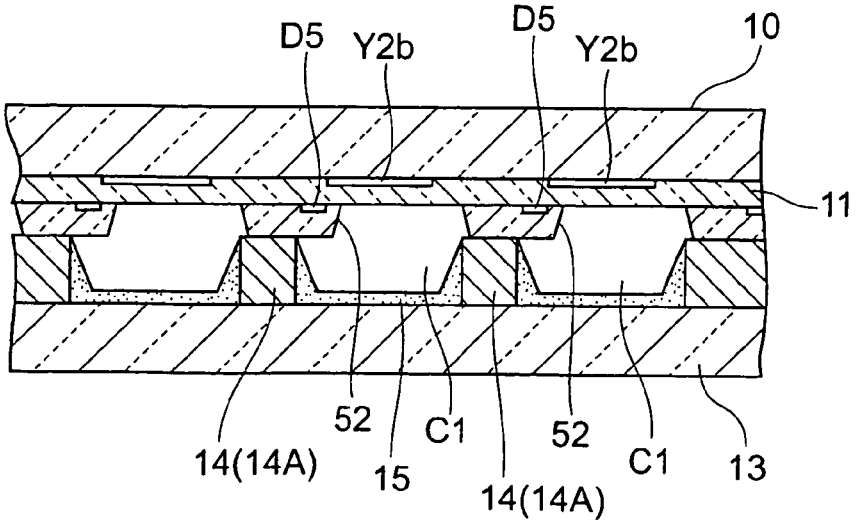
FIG. 20 is a sectional view taken along the W8-W8 line in FIG. 19.

FIGS. 19 and 20 illustrate an eighth example of the embodiment of the PDP according to the present invention. FIG. 19 is a schematic front view showing the structure of a display line of the PDP in the eighth embodiment example, and FIG. 20 is a sectional view taken along the W8-W8 line in FIG. 19.

The transparent electrode in the row electrode pair of the aforementioned first embodiment example has a short rectangular shape elongated in the column direction, whereas transparent electrodes X2*b* and Y2*b* in each row electrode pairs (X2, Y2) of the eighth embodiment example have an approximate T shape, and the narrow proximal ends of the transparent electrodes X2*b*, Y2*b* are connected to the associated bus electrodes X2*a*, Y2*a* and the wide distal ends face each other across a discharge gap.

The column electrode in the seventh embodiment example illustrated in FIGS. 17 and 18 is placed in the offset position in which one of the two edge portions of the column electrode is opposite the vertical wall and the other edge portion faces the discharge cell facing the transparent electrode serving as its partner for initiating the address discharge. By contrast, column electrodes D5 in the PDP of the eighth embodiment example are each placed in an offset position closer to the transparent electrode Y2*b* serving as its proper partner for initiating an address discharge than to the unrelated transparent electrode Y2*b* located on the opposite side (i.e. on the right-hand side in FIGS. 19 and 20), such that the right side of the column electrode D5 comes into rough contact with the left side of the wide distal end of the proper transparent electrode Y2*b* when viewed from the front glass substrate 10. Thus, the entire width of the column electrode D5 is placed outside the area opposite the vertical wall 14A and in a position facing the discharge cell C1 which the transparent electrode Y2*b* serving as its proper partner for initiating an address discharge faces.

Additional dielectric layers 52 are formed on the rear-facing face of the first dielectric layer 11 overlying the row electrode pairs (X2, Y2). Each of the additional dielectric layers 52 extends in the column direction and projects from the rear-facing face of the first dielectric layer 11 so as to overlie the column electrode D5.

The additional dielectric layer 52 is disposed such that, when viewed from the front glass substrate 10, its left edge portion is in contact with the vertical wall 14A and its right edge portion overlying the column electrode D5 is placed in the discharge cell C1 which the transparent electrode Y2*b* serving as the partner of the column electrode D5 for initiating an address discharge faces. The width of the additional dielectric layer 52 in the row direction is larger than that in the case of the seventh embodiment example.

The structure of the other components in the eighth embodiment example is approximately the same as that in the case of the first embodiment example and the same structural components as those in the first embodiment example are designated by the same reference numerals in FIGS. 19 and 20 as those in FIGS. 5 and 6.

In the above PDP, an address discharge between the column electrode D5 and the proper transparent electrode Y2*b* occurs more readily, and thus the occurrence of a false discharge between the column electrode D5 and the unrelated transparent electrode Y2*b* adjacent thereto on the other side is correspondingly prevented. This is because the column electrode D5 is placed in the offset position placed closer the transparent electrode Y2*b* which serves as its proper partner for the initiation of an address discharge, such that it comes into rough contact with the wide distal end of the proper transparent electrode Y2*b* when viewed from the front glass substrate 10. In addition, the column electrode D5 is overlain only by the additional dielectric layer 52, so that the volume of the structure intervening between the column electrode D5 and the transparent electrode Y2*b* of its proper partner for initiating an address discharge is smaller than in the case of the first embodiment example.

The foregoing has described the case when each of the transparent electrodes X2*b* and Y2*b* of the row electrodes X2 and Y2 is formed in an approximate T shape, but a transparent electrode may be formed in a short rectangle extending in the column direction as the case in the first embodiment example.

The foregoing has described the case when the column electrode D5 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

Ninth Embodiment Example

Figure 21:
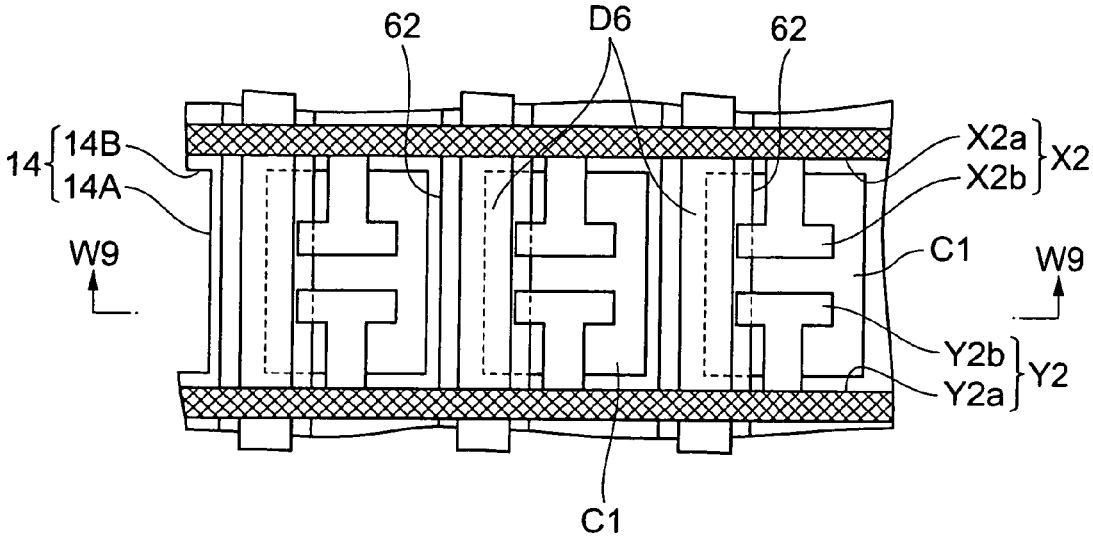
FIG. 21 is a front view illustrating a ninth example of the embodiment of the PDP according to the present invention.
Figure 22:
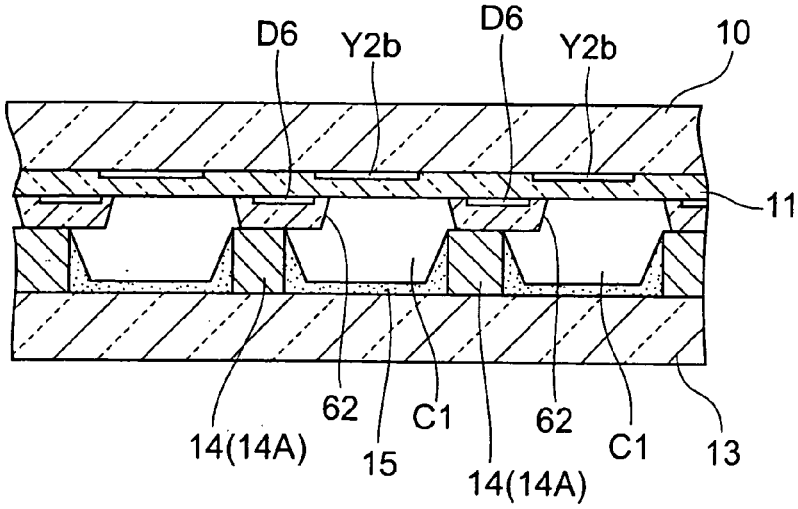
FIG. 22 is a sectional view taken along the W9-W9 line in FIG. 21.

FIGS. 21 and 22 illustrate a ninth example of the embodiment of the PDP according to the present invention. FIG. 21 is a schematic front view showing the structure of a display line of the PDP in the ninth embodiment example, and FIG. 22 is a sectional view taken along the W9-W9 line in FIG. 21.

The column electrode of the eighth embodiment example in FIGS. 19 and 20 is placed in the offset position coming into rough contact with the wide distal end of the transparent electrode when viewed from the thickness direction of the substrate, such that the entire width of the column electrode is placed outside the area opposite the vertical wall of the partition wall unit and the column electrode faces the discharge cell which the transparent electrode serving as its proper partner for initiating an address discharge faces. By contrast, column electrodes D6 in the PDP of the ninth embodiment example are each placed in an offset position closer to the transparent electrode Y2*b* serving as its proper partner for initiation of an address discharge (i.e. toward the right hand in FIGS. 21 and 22), than to the unrelated transparent electrode Y2*b* located on the opposite side, such that the column electrode D6 comes into rough contact with the wide distal end of the proper transparent electrode Y2*b* when viewed from the front glass substrate 10. In addition, the column electrode D6 is formed of a width large enough that its left edge portion in FIGS. 21 and 22 is opposite the vertical wall 14A of the partition wall unit 14 and its right edge portion faces the discharge cell C1 which the transparent electrode Y2*b* serving as the proper partner of the column electrode D6 for initiation of an address discharge faces.

Additional dielectric layers 62 are formed on the rear-facing face of the first dielectric layer 11 overlying the row electrode pairs (X2, Y2). Each of the additional dielectric layers 62 extends in the column direction and projects from the rear-facing face of the first dielectric layer 11 so as to overlie the column electrode D6.

The additional dielectric layer 62 is formed of a width large enough such that, when viewed from the front glass substrate 10, its left edge portion is in contact with the vertical wall 14A and its right edge portion is placed in the discharge cell C1 which the transparent electrode Y2*b* serving as the partner of the column electrode D6 for initiation of an address discharge faces.

The structure of the other components in the ninth embodiment example is approximately the same as that in the case of the eighth embodiment example and the same structural components as those in the eighth embodiment example are designated by the same reference numerals in FIGS. 21 and 22 as those in FIGS. 19 and 20.

In the above PDP, an address discharge between the column electrode D6 and the proper transparent electrode Y2*b* occurs more readily, and thus the occurrence of a false discharge between the column electrode D6 and the unrelated transparent electrode Y2*b* adjacent thereto on the other side is correspondingly prevented. This is because the column electrode D6 is placed in the offset position closer to the transparent electrode Y2*b* which serves as its proper partner for the initiation of an address discharge such that it comes into rough contact with the wide distal end of the proper transparent electrode Y2*b* when viewed from the front glass substrate 10. In addition, the column electrode D6 is overlain only by the additional dielectric layer 62, so that the volume of the structure intervening between the column electrode D6 and the transparent electrode Y2*b* of its proper partner for initiating an address discharge is smaller than in the case of the first embodiment example.

The foregoing has described the case when each of the transparent electrodes X2*b* and Y2*b* of the row electrodes X2 and Y2 is formed in an approximate T shape, but a transparent electrode may be formed in a short rectangle extending in the column direction as the case in the first embodiment example.

The foregoing has described the case when the column electrode D6 is made up of only a belt-shaped portion extending in the column direction, but a column electrode may be composed of a column electrode body extending in the column direction and column-electrode discharge portions extending out from the column electrode body in the row direction so as to face the discharge gap between the row electrodes as illustrated in the example of FIG. 1.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including a pair of first and second substrates placed parallel to each other on either side of a discharge space, and including on the first substrate a plurality of row electrode pairs extending in a row direction and regularly arranged in a column direction and a plurality of column electrodes extending in the column direction and regularly arranged in the row direction, with a plurality of unit light emission areas being formed in matrix form within the discharge space for initiating a discharge therein by use of the row electrode pairs and the column electrodes, wherein row electrodes paired to constitute each of the row electrode pairs have discharge portions placed in accordance with the unit light emission areas and opposite to each other with a discharge gap in between, and each of the column electrodes is placed parallel to a central area between the discharge portions of each row electrode which are adjacent to each other in the row direction, and in a position closer to the discharge portion serving as a partner of the column electrode for initiating a discharge than to another discharge portion which is located on the opposite side of the column electrode from the discharge portion serving as the partner for initiating the discharge.

2. A plasma display panel according to claim 1, wherein each of the row electrodes paired to constitute each row electrode pair has an electrode body extending in the row direction and a plurality of electrode projections regularly arranged along the electrode body and projecting toward the other row electrode of the row electrode pair so as to face the electrode projection of the other row electrode with the discharge gap in between, and each of the electrode projections of the row electrode constitutes the discharge portion.

3. A plasma display panel according to claim 1, wherein each of the column electrodes has a column electrode body extending in the column direction and parallel to a central area between the discharge portions of each row electrode which are adjacent to each other in the row direction and are placed in accordance with the unit light emission areas, and column-electrode discharge portions extending out from the column electrode body in the row direction to face the discharge gap between the discharge portions, and the column electrode body is placed in a position closer to the discharge portion serving as a partner for initiating a discharge than another discharge portion which is located on the opposite side from the discharge portion serving as the partner for initiating the discharge.

4. A plasma display panel according to claim 1, comprising a partition wall unit provided between the pair of first and second substrates and having at least vertical walls each extending in the column direction to provide a partition between the unit light emission areas adjacent to each other in the row direction in the discharge space, wherein each of the column electrodes is placed within a range in which the column electrode is opposite to the vertical wall in a thickness direction of the first and second substrates.

5. A plasma display panel according to claim 1, comprising a partition wall unit provided between the pair of first and second substrates and having at least vertical walls each extending in the column direction to provide a partition between the unit light emission areas adjacent to each other in the row direction in the discharge space, wherein each of the column electrodes is placed within a range in which the column electrode faces a central area between the vertical wall of the partition wall unit and the discharge portion of the row electrode in each unit light emission area.

* * * * *